US006108989A

United States Patent [19]

Kordes et al.

[11] Patent Number: 6,108,989

[45] **Date of Patent: *Aug. 29, 2000**

[54] WALL PARTITION SYSTEM AND A DEVICE FOR SECURING A WALL PARTITION SYSTEM

[75] Inventors: Herbert Kordes; Lars Wehrspann, both of Bad Salzuflen, Germany

[73] Assignee: Dorma GmbH & Co. KG, Ennepetal, Germany

[ * ] Notice: This patent issued on a continued prosecution application filed under 37 CFR 1.53(d), and is subject to the twenty year patent term provisions of 35 U.S.C. 154(a)(2).

[21] Appl. No.: 08/898,216

[22] Filed: Jul. 22, 1997

[30] Foreign Application Priority Data

Oct. 17, 1995 [DE] Germany ..... 195 38 485

[51] Int. Cl.[7] ..... E05C 7/06

[52] U.S. Cl. ..... 52/243.1; 52/64; 52/241; 49/127; 49/308; 49/309; 160/225; 292/177; 292/139; 292/140

[58] Field of Search ..... 52/64, 238.1, 241, 52/243.1; 160/222, 225, 196.1, 200, 205, 214; 292/177, 182, 139, 140; 49/127, 130, 307, 308, 310, 313, 309

[56] References Cited

U.S. PATENT DOCUMENTS

| | | | |
|---|---|---|---|
| 639,026 | 12/1899 | Fernald | 49/307 |
| 649,150 | 5/1900 | Winter | 49/308 |
| 1,111,737 | 9/1914 | Coonradt | 49/307 |
| 1,524,005 | 1/1925 | Dodge | 292/177 X |
| 2,035,723 | 3/1936 | Robinson | 49/307 |
| 2,180,112 | 11/1939 | Jones | 49/308 |
| 3,143,760 | 8/1964 | Ferguson . | |
| 3,250,314 | 5/1966 | Wetzel | 160/40 |
| 3,280,526 | 10/1966 | Depitone | 52/240 X |
| 3,374,821 | 3/1968 | White | 160/40 |
| 3,704,547 | 12/1972 | Hansen et al. | 49/308 |
| 3,802,480 | 4/1974 | Daggy | 160/40 |
| 4,395,854 | 8/1983 | White et al. | 52/64 |
| 5,005,881 | 4/1991 | Bailey et al. | 292/177 X |

FOREIGN PATENT DOCUMENTS

| | | | |
|---|---|---|---|
| 507229 | 4/1953 | Belgium | 49/308 |
| 722344 | 11/1965 | Canada | 52/64 |
| 1470504 | 2/1967 | France . | |
| 4041925 | 3/1992 | Germany . | |
| 4428718 | 2/1996 | Germany . | |
| 596956 | 8/1959 | Italy | 49/307 |
| 11378 | 6/1900 | United Kingdom | 292/182 |
| 264971 | 2/1927 | United Kingdom | 49/308 |

OTHER PUBLICATIONS

Dorma HSW–R "Frames", Dorma–Glas GmbH, Aug. 1992.

*Primary Examiner*—Laura A. Callo
*Attorney, Agent, or Firm*—Nils H. Ljungman and Associates

[57] ABSTRACT

A movable wall comprises individual suspended door and/or wall elements. The individual elements are automatically locked both to one another and in the floor. For this purpose, in a base profile which is fastened to the underside of the elements, there is structure which effects an automatic locking of the elements to one another and in the floor, when two elements come together.

13 Claims, 7 Drawing Sheets

WALL PARTITION SYSTEM AND A DEVICE FOR SECURING A WALL PARTITION SYSTEM

BACKGROUND OF THE INVENTION

1. Field of the Invention

This invention relates to a movable wall which consists of individual door or wall segments or elements, which elements are used to enclose a building or a portion of the building. Such movable walls are thereby moved during conventional business hours out of their installed positions into a parked position on the side, or into what is sometimes termed a "railroad station". The door or wall elements are mounted so that they are suspended from a rail, which rail is fastened to the ceiling. The individual door or wall elements can include all-glass door panels which have a profile in the upper portion which is used for fastening, and a profile in the lower portion which is used for locking, or they can also include elements in frames. In the latter case, panes of glass are preferably installed inside the framed elements.

2. Background Information

A suspended movable wall consisting of individual elements is described in German Patent No. 40 41 925. The individual elements are thereby mounted on trucks, of which there are two on each individual element. Each truck is thereby fastened to a profile, which profile is attached in the upper portion of the element. These trucks are guided in a rail which is fastened to the ceiling. The ceiling rails are constructed so that the trucks are inside the rails in a manner which makes them essentially invisible to the user. Guide rollers on the side of the truck provide the correct guidance, and in addition to the guide rollers, there are also load-bearing or support rollers.

Such a movable wall is described, for example, in the documentation entitled "DORMA HSW-R". The glass panel facades in this document are used to provide secure protection for display windows, entrances to stores and restaurants and winter gardens against gusts of wind and rain. The individual elements can be moved into a parked position to conserve the available space and keep the elements out of the way during periods when the entrance is to be open. In this known application, the moving panels are not guided in the floor, which eliminates edges over which pedestrians can trip and places where dirt can accumulate. Locks, latches and other accessories can be located in a profile which is located near the floor and which is fastened to the individual element. The panels are thereby locked in place manually, i.e. in the floor there are sockets for latches and latch plates for the latches, or also for the locks whereby when a button on each individual retracted panel is actuated—after the close of business—these panels can be fastened securely in their installed position. This method of fixing the movable wall elements in place is very complex, time-consuming and expensive, because each panel must be fixed in place individually.

A lock for individual doors which are locked automatically by means of a locking bolt is described in U.S. Pat. No. 3,143,760. The locking bolt which is inserted in the top frame of a door thereby works with a system of rotating levers which are spring-loaded. On the lever system, there is an actuator lever which projects out of the vicinity of the door jamb and which, when the door is placed in the closed position, simultaneously allows the bar to engage in a boring in the door panel. When the locking bolt is engaged in a socket in the door panel, the door panel is locked.

OBJECT OF THE INVENTION

The object of the invention is to automate the process of locking the individual movable elements, which process can be very complex and time-consuming when performed manually.

SUMMARY OF THE INVENTION

The invention teaches that this object can be accomplished if, when at least two or, in another embodiment, all of the door elements come together, they are automatically locked in the floor. Such a procedure is possible because, in the lower base profile on one end surface of each element, there is a locking device with a tappet connected inside. When one panel end surface contacts another panel end surface, the tappet automatically actuates a locking bolt or pin, which locking bolt is pushed into a floor socket which is recessed in the floor. A load is thereby exerted on the locking bolt by a spring element, so that when the tappet is not actuated, the locking pin is moved inside the locking device and thus inside the panel. Therefore, if there is no actuation, the locking bolt is automatically extracted from the floor socket.

Inside a locking device, a locking bolt is mounted vertically in a boring. This locking bolt is spring-loaded, so that when it is not actuated by a tappet, it is retracted inside the locking device. A horizontally operating tappet with a connected control or cam plate interacts with this locking bolt. The control plate can be displaced horizontally in a pocket inside the locking device. In the unactuated position, the tappet projects out of the locking device and thus out of the panel. Inside the locking device, in the same axis as the axis in which the locking bolt moves, there is an opening through which a guide pin extends. This guide pin also and simultaneously runs through the control plate, namely through a control bevel in the form of an opening.

As a result of the horizontal movement of the tappet, i.e. as the tappet is pushed into the panel, as a result of the coupling via the guide pin and the control bevel of the control plate, the locking bolt is also pushed out of the locking device and thus out of the panel, which results in the insertion of the locking bolt into the floor socket which is in the floor. In other words, when the locking bolt is locked inside the floor in a floor socket, the guide pin reaches its lowest point inside the vertical opening and also inside the control bevel.

When the edges of two panels come together, first the tappet is inserted into a boring in the impacting panel, and then, on account of the automatic movement, the locking bolt is pushed out of the locking device, and simultaneously the tappet is pushed into the locking device. On account of the coordinated dimensions, however, the tappet continues to project out of the locking device by a certain amount, namely an amount substantially equal to the depth of the boring in the neighboring panel, and thus simultaneously the two impacting panels are locked to one another.

In additional embodiments of the invention, a load is applied to the locking bolt by a spring element, so that when there is no tappet, the bolt is automatically extracted from the floor socket. In addition to the simple use of a spring element, the bolt can also be extracted from the socket for unlocking in connection with a lever system, with a spring fastened to it to improve the transmission of force. In one embodiment of the teaching of the invention, however, it is also possible to do without the spring elements altogether, namely if on one side of each movable element there is a tappet with automatic guidance, and on the opposite side there is the corresponding locking device. When the tappet, which has a substantially fork-shaped recess which extends along a path from top to bottom, strikes a panel, the locking bolt is automatically driven by means of a pin which is on the locking bolt and is pushed downward out of the base profile strip and is then inserted into the socket which is in the floor. As a result of the fork-shaped inclined path of the driver, the locking bolt is therefore held in the locking position. If a movable wall element with the driver is pushed back into the parked position, the driver then moves back out of the adjoining base strip of the adjacent wall element. At the same time, on account of its configuration, the locking bolt automatically moves back out of the locking position, i.e. it is extracted from the floor socket. In order for the locking bolt to then be fixed in this position in the base strip, a retaining pin, which retaining pin is attached to the side and is loaded by a ball, for example, can be engaged inside an encircling groove to hold the locking bolt in place. The release force can be adjusted and thus applied by means of the retaining pin.

A locking device constructed in this manner is capable of automatically, invisibly and securely locking movable wall elements together in the vicinity of the floor. Therefore, the locking mechanism which would otherwise have to be actuated manually becomes unnecessary, which makes things a great deal easier for the persons whose job it is to move the walls. The invention also teaches that it is unnecessary to use an additional tool to lock the individual door or wall elements to one another.

The above discussed embodiments of the present invention will be described further hereinbelow with reference to the accompanying figures. When the word "invention" is used in this specification, the word "invention" includes "inventions", that is, the plural of "invention". By stating "invention", the Applicants do not in any way admit that the present application does not include more than one patentably and non-obviously distinct invention, and maintains that this application may include more than one patentably and non-obviously distinct invention. The Applicants hereby assert that the disclosure of this application may include more than one invention, and, in the event that there is more than one invention, that these inventions may be patentable and non-obvious one with respect to the other.

BRIEF DESCRIPTION OF THE DRAWINGS

The invention is explained in greater detail below with reference to several possible embodiments which are illustrated schematally in the accompanying drawings, wherein.

DESCRIPTION OF THE PREFERRED EMBODIMENT

Figure 1:
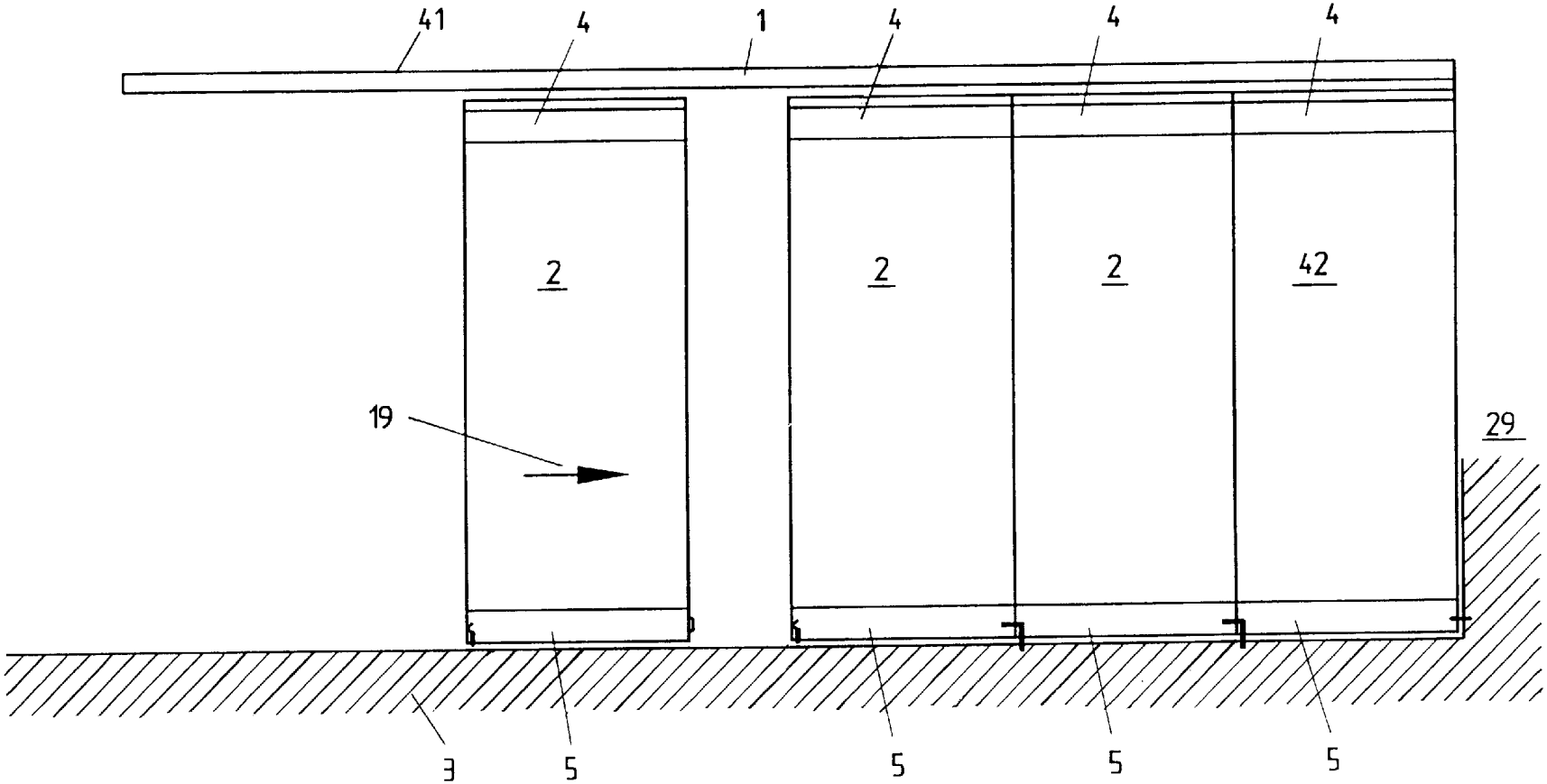
FIG. 1 shows a movable wall.

FIG. 1 is a schematic illustration of a movable wall. A rail 1 can be positively and/or non-positively fastened or in other words can be frictionally and interlockingly fastened to a ceiling 41 of a building. Inside the rail 1 there is a suspension system which includes devices (not shown) on support profiles 4 of individual panels 2, which devices make it possible to displace the individual elements of the panels 2. To keep the description simple, only the term "panels" will be used below, although it is theoretically possible to manufacture such movable wall elements from any suitable material, in particular glass. It is thereby unimportant whether the individual elements are in frames or are unframed. In the vicinity of the floor 3, the panels 2 are provided with a base profile 5. The first panel of the movable wall, namely the panel 42, is held by a stop 30 in front of a wall 29. The adjacent panels 2 are each locked to one another and simultaneously in the floor 3 by means of a locking device. This locking is accomplished by moving the individual panels 2 in the direction of movement 19, and when two panels 2 come into contact with one another, they are simultaneously locked to one another and to the floor 3.

Figure 1A:
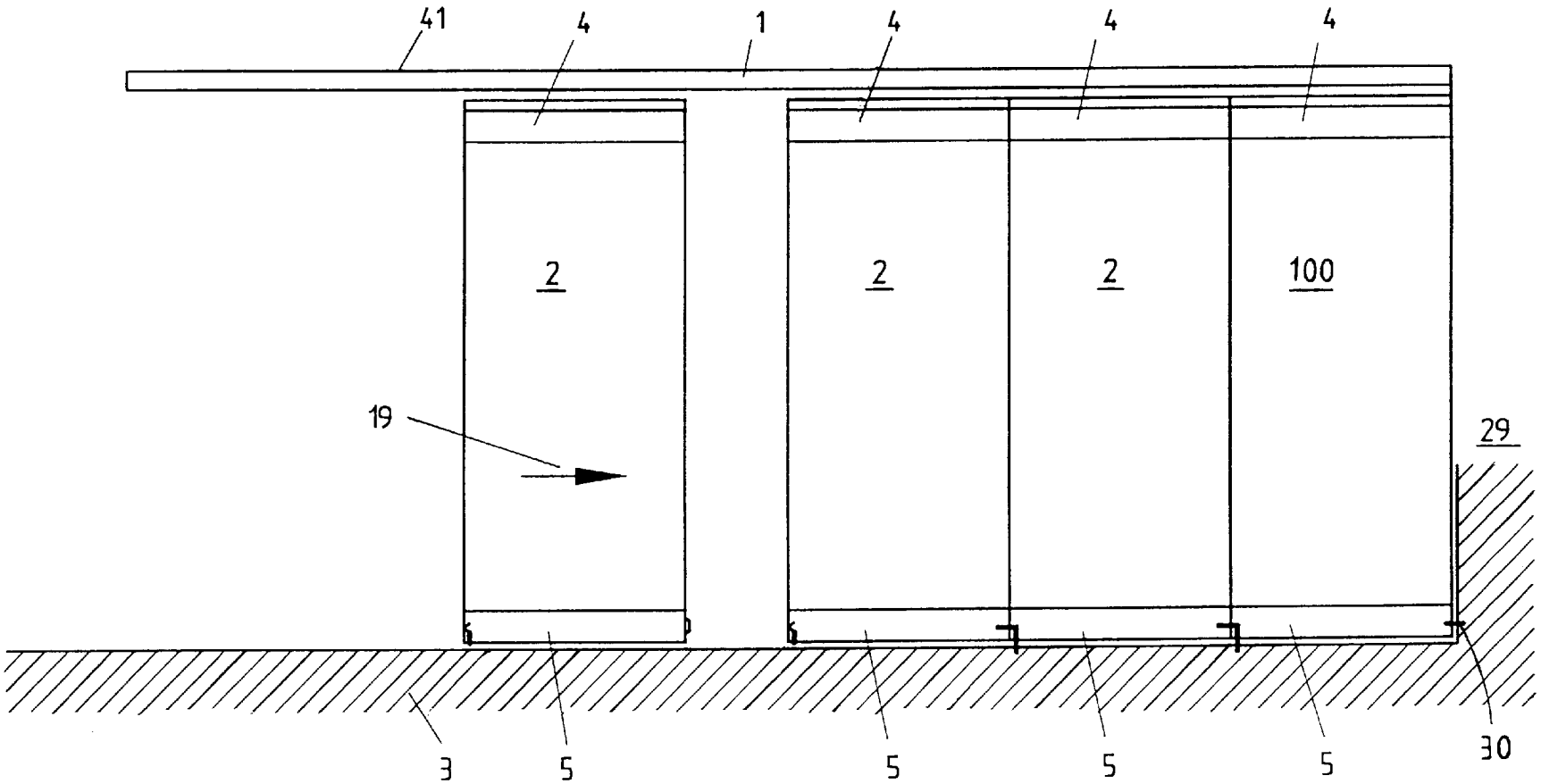
FIG. 1A shows additional detail of the view shown in FIG. 1.

FIG. 1A shows an embodiment where the first panel 100, is held adjacent the wall 29 by a stop 30.

Figure 2:
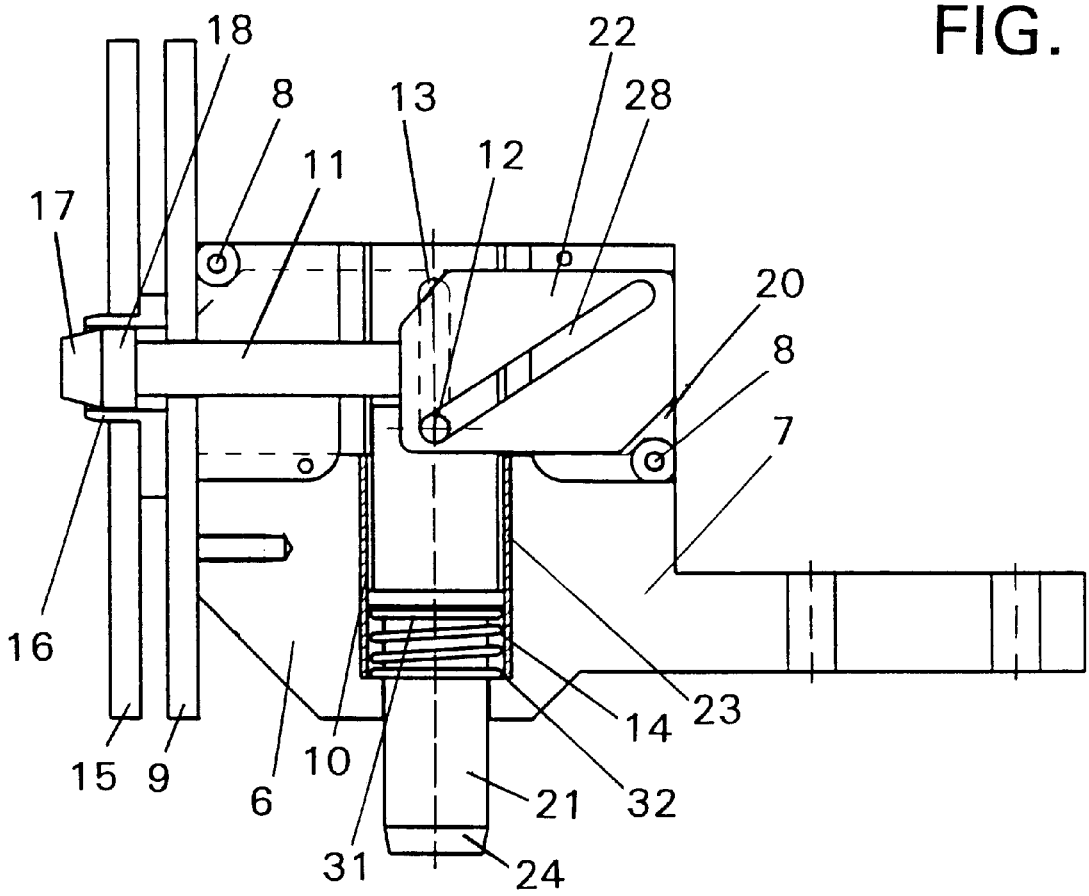
FIG. 2 shows a realization of the locking device in the locked position.

FIG. 2 shows the locking device in accordance with the invention in the locked position, where a locking bolt 21 is inside the floor socket 25 (see FIG. 4) which socket 25 is recessed in the floor 3. The socket 25 has a blind hole 26, and the end of the socket 25 is firmly connected to the floor 3 by means of a fastener 27. To facilitate the insertion of the locking bolt 21, there is a chamfer or bezel or bevel 24 on the projecting end of locking bolt 21.

Figure 3:
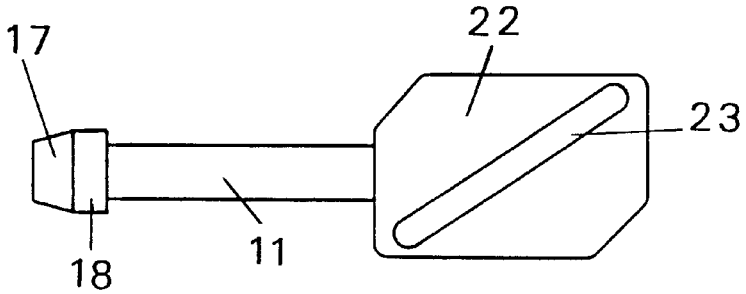
FIG. 3 shows the control plate with tappet.

The locking device 6 consists essentially of a base body 7, in which base body 7 there is a vertical boring 10 in which a friction bearing 23 has been inserted to improve the guidance of the locking bolt 21. The portion of the locking bolt 21 inside the base body 7 has a diameter which is larger than the diameter of the projecting portion. This difference in diameters is necessary so that the locking bolt 21 can also be moved by a spring 14 into an idle position. The spring 14 is thereby supported in the base body 7 in the boring 10 on one end 32 of the boring 10 on one hand, and on the other hand against a stop 31 which is on the locking bolt 21. A guide pin 12 is inserted positively and/or non-positively or, in other words can be frictionally and interlockingly inserted in this locking bolt 21, on the end of the locking bolt 21. The length of the guide pin 12 is determined so that it extends beyond the diameter of the locking bolt 21. The ends of the guide pin 12 which extend out of the locking bolt 21 can move in an opening 13 which is oriented vertically inside the base body 7. There is also a recess (not shown) on the end of the locking bolt 21. Inside this recess, there is a control plate 22 which can be displaced horizontally inside the base body 7 see FIG. 3.

The control plate 22 interacts with a tappet 11, which tappet 11 can also be displaced horizontally and projects out of the panel 2. The tappet 11 can be positively and/or non-positively or, in other words can be frictionally and interlockingly connected to the control plate 22. Inside the control plate 22, there is a control bevel 28 which is realized in the form of an opening. The guide pin 12 also runs through this control bevel 28 and thus, when the tappet 11 is actuated in the horizontal direction, causes a vertical displacement of the locking bolt 21 by means of the control bevel 28. The dimensions of the control bevel 28 and the opening 13 are coordinated with one another so that a smooth horizontal sliding inside the pocket 20 is possible, as well as inside the locking bolt 21 of the control plate 22.

On its end which projects out of the panel, the tappet 11 has a head 18, on the end of which head 18 there is a chamfer 17 which chamfer 17, to facilitate the seating of the second panel, is inserted into a boring or depression 16 in a cover plate 15. As a result of the insertion of the head 18 into the neighboring panel, the two panels are locked to one another. If the panels are pushed further in the direction of movement 19, then on account of the automatic guidance provided by the control bevel 28, the locking bolt 21 penetrates into the floor socket, and thereby simultaneously locks the panels in the vicinity of the floor 3.

The overall locking device 6 is fastened in a recessed manner by means of fasteners 8 on one end surface of a panel 2. The lateral closure is thereby formed by a cover plate 9 through which the tappet 11 extends.

The teaching of the invention can be applied both on manually operated and on automatically operated movable wall elements or movable partitions. The invention guarantees that the individual elements are always locked to one another and to the ground, when the elements are in contact with one another by means of their end surfaces.

In other words, and in accordance with one embodiment of the present invention, each panel can have a locking device 6, which locking device 6 can preferably be actuated by contact of one panel 2 with an adjacent panel 2 as a result of movement of one panel toward the other panel. For example, the locking device 6 located on panel 42 can be activated upon contact of adjacent panel 2, as a result of adjacent panel 2 being moved toward panel 100, in the direction of movement 19. Upon the adjacent panel 2 coming into contact with the head 18 of tappet 11 of panel 100, tappet 11 can be moved from an extended position wherein tappet 11 projects outward from panel 100, in a direction corresponding to direction 19. Tappet 11 and control plate 22, due to a connection therebetween, can thus move in the direction of motion 19 which causes the guide pin 12, connected to the locking bolt 21, to move from an upper position in control bevel or slot 28 to a lower position by a sliding movement. As guide pin 12 moves to a lower position within control bevel 28, locking bolt 21 thus moves in a vertical direction and into a recess in the floor.

In accordance with one embodiment, each panel can preferably have a recess, such as boring 16, which is aligned with the tappet 11 of the adjacent panel, so that when a panel is moved toward the adjacent panel, the tappet 11 slides into this recess 16 to "lock" or secure the panels together. For example, a cover plate 15 may be located on the edge of each panel, so that the tappet 11 of each panel can, upon movement of one panel toward the adjacent panel, slide into boring 16 of cover plate 15.

In accordance with one embodiment, boring 16 in cover plate 15 may be sized so as to create a friction fit between head 18 of tappet 11 and boring 16 so that when a panel is moved toward an adjacent panel, tappet 11 is inserted into boring 16 and upon further movement of the panel in direction 19, tappet 11 moves along with the moving panel and thus lowers locking bolt 21 into the floor. Alternatively, instead of a friction fit between the boring 16 and the head 18 of tappet 11, there may simply be a recess in the panels, which recess has a vertical surface which, once the head 18 of tappet 11 slides into boring 16, eventually comes into contact with head 18 and pushes tappet 11 in direction 19 to move locking pin 21 into the recess in the floor. In this case, the boring 16 can simply act as a guide for the head 18 of tappet 11.

In accordance with one embodiment, spring 14 can preferably bias locking pin 21 in a direction away from the floor, i.e. inside base body 7. Thus, when a panel is moved away from an adjacent panel and the contact between head 18 of tappet 11 and the adjacent panel is lost, spring 14 pulls locking pin 21 out of the floor and moves tappet 11 back into its extended position by the movement of guide pin 12 from a lower position in control bevel 28 to an upper position.

Figure 4:
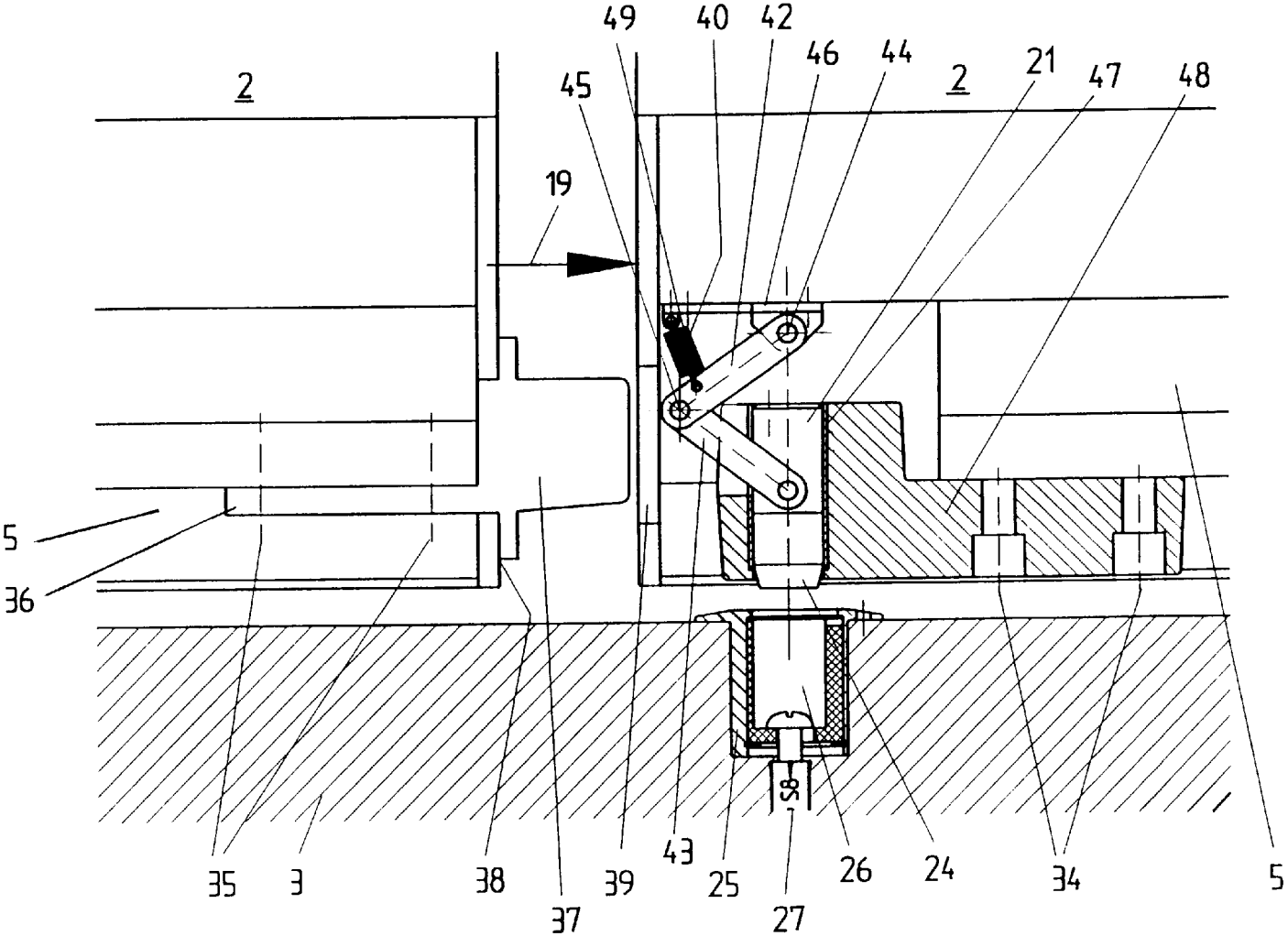
FIG. 4 shows the locking device which uses a lever system, in the unlocked position.
Figure 5:
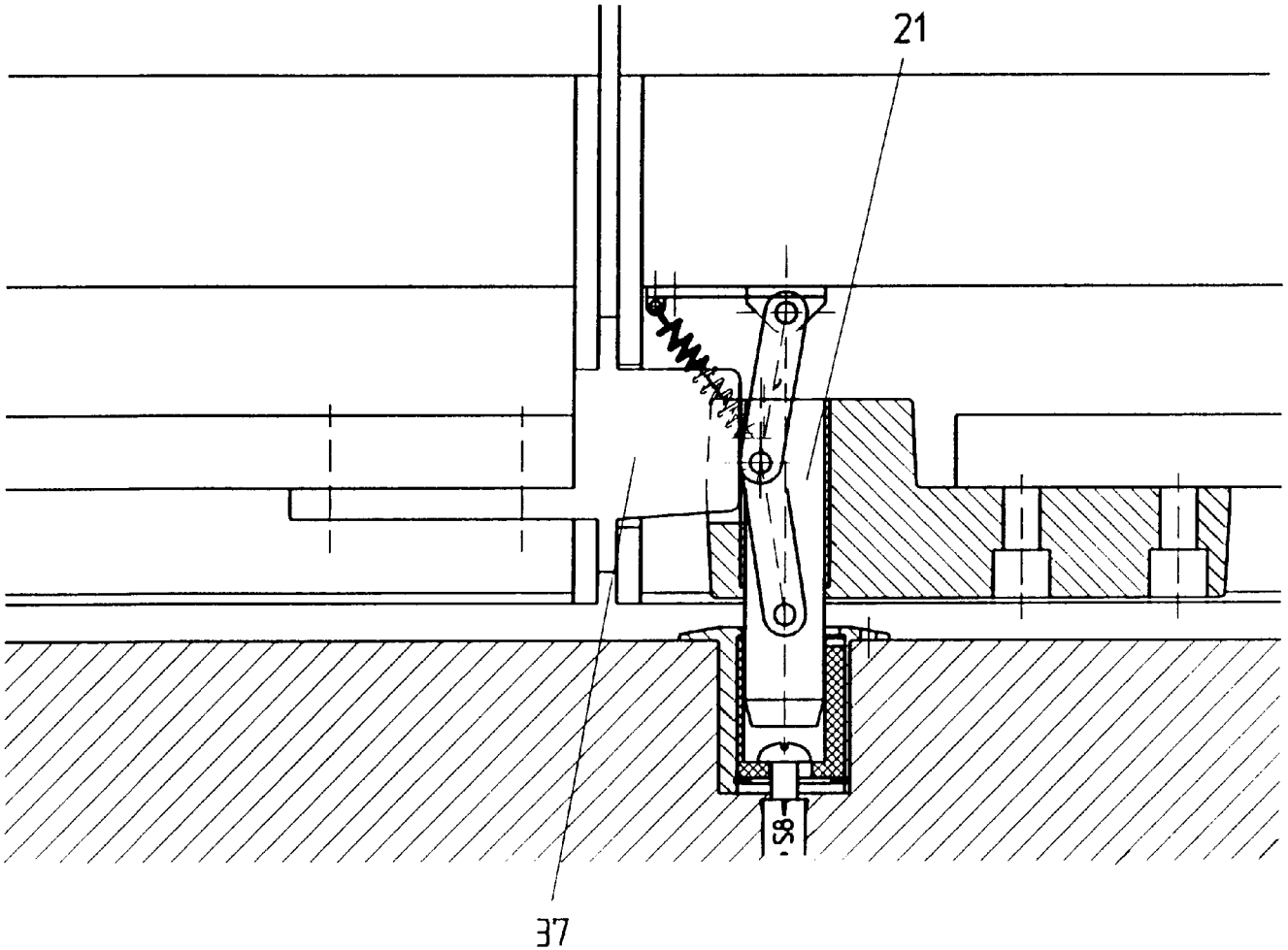
FIG. 5 shows the same view as FIG. 4, but in the locked position.

FIG. 4 shows an additional embodiment of a lock, shown in the unlocked position. Each of the panels 2, on one side of the base profile 5, has a tappet 37, and on the opposite side an opening 39, behind which there is the locking device for the locking of the individual panels 2. As a result of the insertion of the tappet 37 in the direction of motion 19 into the opening 39, the two panels 2 are locked or connected together when they come into contact with one another. The tappet 37 can thereby include, for example, a projecting part which has at least one contact surface 38, which contact surface 38 is simultaneously in contact with the end surface of the base profile 5. Inside the base profile 5 there is a fastening leg of the tappet 37, which is positively and non-positively fastened inside the base profile 5 so that it is out of sight. On the opposite side, inside the base profile 5, there is a locking device which locking device includes a retaining piece 48 with a locking bolt 21 guided inside it. The locking bolt or device 21 is guided in a vertically oriented boring 47 so that when the locking bolt 21 exits from the base profile 5, it can penetrate into a floor socket 25 which is recessed in the floor. The locking bolt 21, on its forward side, thereby has a chamfer 24 to facilitate its insertion into a blind hole 26 of the floor socket 25. The floor socket 25 is thereby securely fastened in the floor 3 by means of a fastener 27. At the same time, a lever system which includes the levers 42, 43 is connected to the locking bolt 21. The lever 43 is thereby rotationally mounted on one end on the locking bolt 21 and on the other end at a fulcrum or pivot 45 is rotationally connected to one end of the lever 42. The other end of the lever 42 is non-positively connected at a fulcrum 44 with a mounting 46. At the same time, the lever 42 is provided with a spring 40 which spring 40 holds the two levers 42, 43 in the idle position so that the locking bolt 21 lies retracted inside the socket profile 5. The two levers 42, 43 have an angular position such that the fulcrum 45 points toward the opening 39 inside the base profile 5. If the tappet 37 of the second panel 2 then comes into contact with the levers 42, 43, as a result of the force applied from the horizontal direction, a vertical force is exerted on the locking bolt 21, which causes the locking bolt 21 to be pushed out of the retainer piece 48 and thus out of the base profile 5. This locking position is illustrated in FIG. 5. The retaining piece 48 can thereby be positively and/or non-positively or, in other words can be frictionally and interlockingly, connected to the base profile 5 by means of fasteners 34.

In one embodiment of the present invention, the retaining piece 48 can be connected to the base profile 5 of the panel 2 by means of connecting bolts 34. Similarly, the tappet 37 can have a base leg 36, which base leg 36 can be positively and/or non-positively or, in other words can be frictionally and interlockingly, connected to the base profile 5 of its panel 2 by means of connecting bolts indicated schematically at 35.

Also in one embodiment of the present invention, the spring 40 can be connected to the panel 2 by a connecting element 49.

Figure 6:
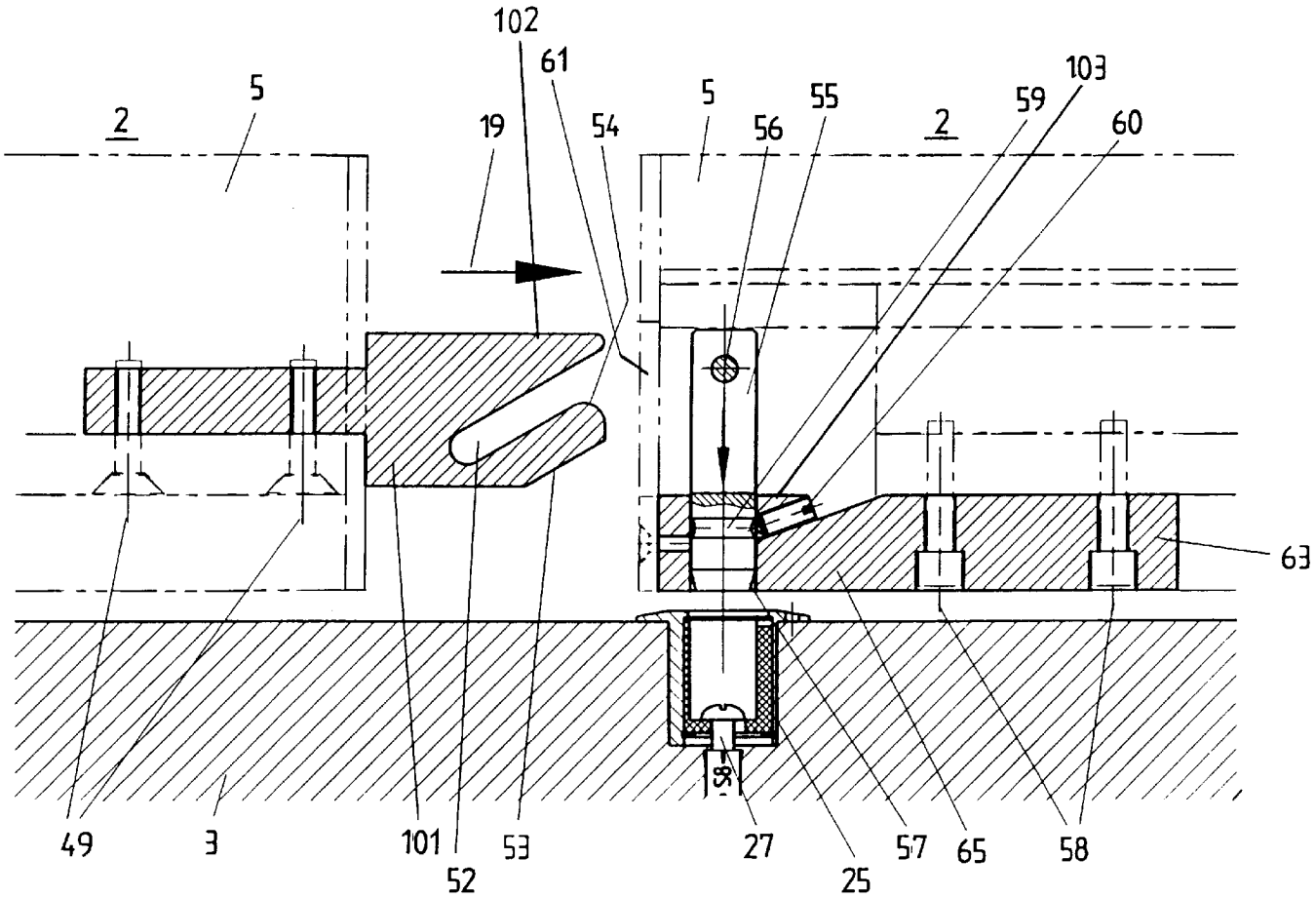
FIG. 6 shows a realization with an automatic driver in the unlocked position.
Figure 7:
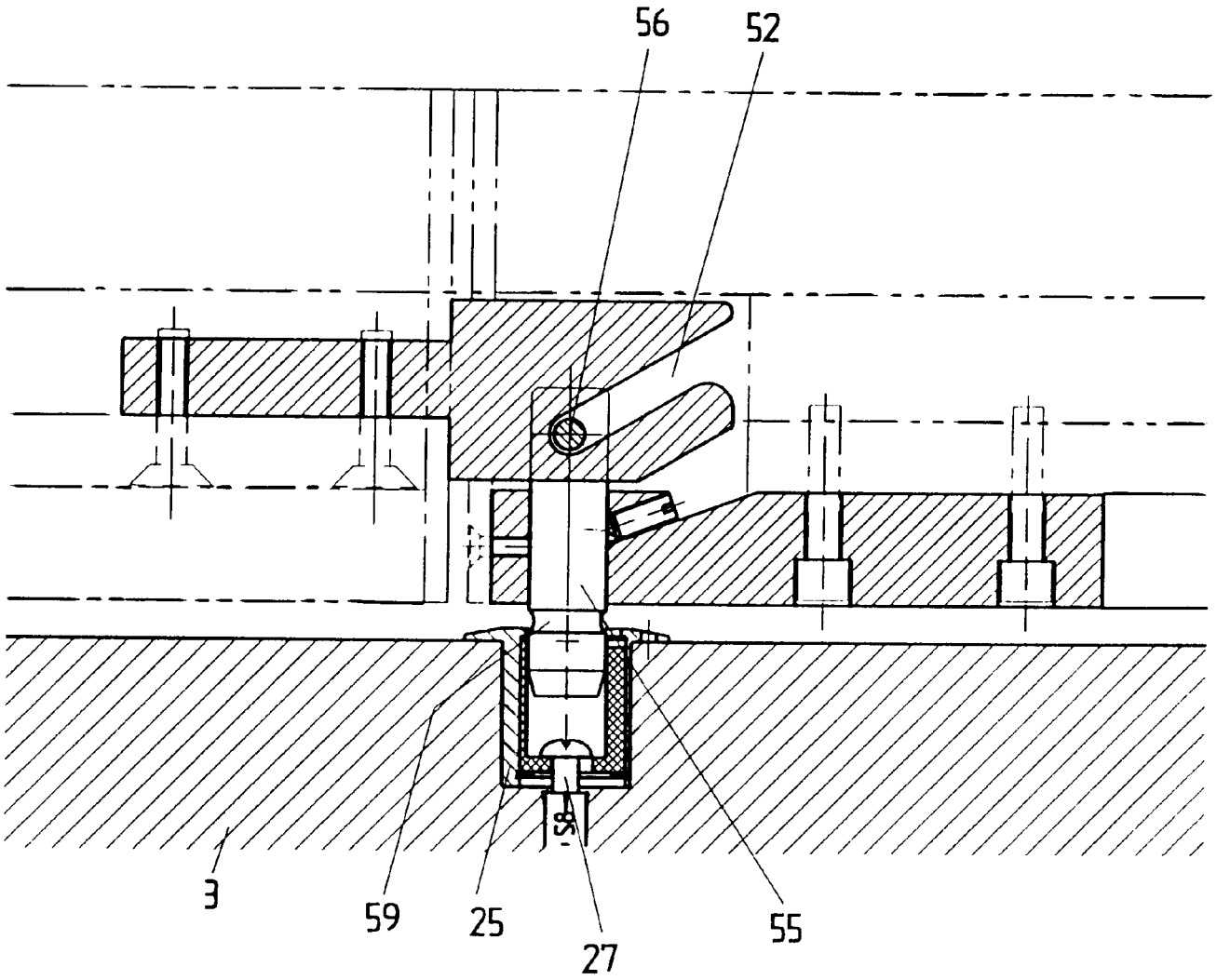
FIG. 7 shows the same view as FIG. 6, in the locked position.

FIGS. 6 and 7 illustrate one embodiment of the teaching of the invention in which there is a different type of locking between the panels 2 and in the vicinity of the floor 3. As described above, on one side of each base profile 5 there is a driver 51, and on the opposite side of the same panel there is a locking device. The driver 51 is designed so that inside the base profile 5 it can be connected positively and/or non-positively or, in other words can be frictionally and interlockingly connected, to the base profile 5 by means of fasteners 49. The projecting portion of the driver 51 has a fork 52 which is characterized by a configuration in which the open end of the fork 52 is up and to one side, and the fork runs vertically downward. On the arms or extensions or projections of the fork 52, there are rounded portions 54. There is also one inlet bevel 53 which is located underneath the fork 52 on the driver 51.

The locking device can include a retaining part 63 which retaining part 63 can be positively and/or non-positively or, in other words can be frictionally and interlockingly, connected by means of fasteners 58 inside the base profile 5. The retaining part 63 also has a boring 65 in which a locking bolt 55 is displaced vertically. The locking bolt 55, on its projecting end, has a chamfer 57 which facilitates its insertion into the floor socket in the floor. To hold the locking bolts 55 in this position, there is an adjustable retaining pin 60 on one side. This retaining pin 60, on its forward end, has a spring-loaded ball which is engaged in an encircling groove 59 which is in the locking bolt 55. If the locking bolt 55 is pushed out of the base profile 5, the retaining force represented by the retaining pin 60 is simultaneously neutralized, and the locking bolt 55 can be pushed into the locked position. In the upper portion of the locking bolt 55, at a right angle to the locking bolt 55, there is a driver pin 56. This driver pin 56 makes it possible, together with the driver 51 and the fork 52 in the driver pin 56, to automatically move the locking bolt 55.

When the driver 51 comes into contact with the panel 2 facing it, as a result of the insertion of the driver 51 in a opening 61 of the panel 2, there is a locking of the two panels 2 which come into contact with one another. At the same time, the driver pin 56 comes into contact with the driver 51, which as a result of the inclined fork 52 in the driver 51, means that the locking bolt 55 is automatically pushed out of the base profile 5. This situation is visible in particular in FIG. 7, where the panels 2 are locked both to one another and in the floor 3. As a result of the automatic guidance by means of the fork 52, it is not necessary to perform a manual locking of the individual panels 2. When two panels 2 are moved away from one another, the locking bolt 55 is also automatically extracted from the floor socket, which guarantees an unlocking from the floor. If the panel 2 is displaced further, the panels 2 are also unlocked from one another.

In at least one embodiment of the present invention, the driver 51 is connected to the base profile of the panel 2 with fasteners 49, which fasteners 49 can positively and/or non-positively or, in other words can frictionally and interlockingly, connect the driver 51 to the base profile 5. The driver 51 has a projecting end 101, which projecting end 101 is positioned to engage with the locking device. The projecting end 101 has arms 32, 102 which arms 32, 102 are separated from one another by a slot 52. The lower arm 32 also has a bevelled surface 53. The locking device consists of a retaining part 63 which retaining part 63 can be positively and/or non-positively or, in other words can be frictionally and interlockingly, connected by means of fasteners 58 inside the base profile 5. The retaining part 63 also has a boring 65 in which a locking bolt 55 is displaced vertically. The locking bolt 55, on its projecting end, has a chamfer 57 which chamfer 57 facilitates its insertion into the floor socket 25 in the floor 3. To hold the locking bolts 55 in this position, there is an adjustable retaining pin 60 on one side. This retaining pin 60, on its forward end, has a spring-loaded ball 103, which spring-loaded ball 103 is engaged in an encircling groove 59 which is in the locking bolt 55. If the locking bolt 55 is pushed out of the base profile 5, the retaining force represented by the retaining pin 60 is simultaneously neutralized, and the locking bolt 55 can be pushed into the locked position. In the upper portion of the locking bolt 55, at a right angle to the locking bolt 55, there is a driver pin 56. This driver pin 56 makes it possible, together with the driver 51 and the fork 52 in the driver 51, to automatically move the locking bolt 55.

The teaching of the present invention can be applied both to movable wall elements which are moved manually and to wall elements which are moved automatically. The present invention can also guarantee that the individual elements are always locked to one another and are locked in the floor.

One feature of the invention resides broadly in the movable wall which consists of individual suspended door and/or wall elements which can be displaced in a stationary rail in the form of a hollow box which is fastened to the ceiling, which rail has branches and intersections, whereby the individual door and/or wall elements are not guided in the area close to the floor and have a base profile, characterized by the fact that in the base profile 5 there is a locking device which, when at least two door and/or wall elements come together, automatically locks the elements to one another and locks them in the floor 3.

Another feature of the invention resides broadly in the movable wall characterized by the fact that the horizontal direction of motion of a tappet 11 is diverted by a control plate 22 into a vertical direction of motion of a locking bolt 21.

Yet another feature of the invention resides broadly in the movable wall characterized by the fact that the locking device 6 is on one side of each base profile 5.

Still another feature of the invention resides broadly in the movable wall characterized by the fact that inside the locking device 6 there is a pocket 20 in which the control plate 22 can be displaced, whereby in the control plate 22 there is a control bevel 28 or opening, which interacts with a guide pin 12 which is fastened positively and non-positively in the locking bolt and can be displaced in an opening 13 in the base body 7 of the locking device 6.

A further feature of the invention resides broadly in the movable wall characterized by the fact that on one side of each base profile 5 there is a tappet 37 and on the other side there is a locking device which is actuated by the tappet 37.

Another feature of the invention resides broadly in the movable wall characterized by the fact that the locking device consists of a locking bolt 21 which is automatically pressed into a floor socket 25 which is recessed in the floor 3.

Yet another feature of the invention resides broadly in the movable wall characterized by the fact that the locking bolt 21 is actuated indirectly.

Still another feature of the invention resides broadly in the movable wall characterized by the fact that the locking bolt 21 is actuated directly.

A further feature of the invention resides broadly in the movable wall characterized by the fact that on the locking bolt 21, there is a lever system which consists of at least two rotationally mounted levers 42, 43.

Another feature of the invention resides broadly in the movable wall characterized by the fact that the tappet 37 is formed by a driver 51 which has a fork 52 and by means of a driver pin 56 which is on the locking bolt 21 pushes the locking bolt 21 into the locking position or pulls it out of the locking position.

Yet another feature of the invention resides broadly in the movable wall characterized by the fact that the door and/or wall elements are locked to one another by the tappets 37 or drivers 51 which are inserted in the respective opening 39 or 41 which lies in front of them.

The components disclosed in the various publications, disclosed or incorporated by reference herein, may be used in the embodiments of the present invention, as well as, equivalents thereof.

The appended drawings in their entirety, including all dimensions, proportions and/or shapes in at least one embodiment of the invention, are accurate and to scale and are hereby included by reference into this specification.

All, or substantially all, of the components and methods of the various embodiments may be used with at least one embodiment or all of the embodiments, if more than one embodiment is described herein.

All of the patents, patent applications and publications recited herein, and in the Declaration attached hereto, are hereby incorporated by reference as if set forth in their entirety herein.

The corresponding foreign and international patent publication applications, namely, Federal Republic of Germany Patent Application No. DE 195 38 485.7, filed on Oct. 17, 1995, DE 196 33 561.2, filed on Aug. 21, 1996, and PCT/DE96/01747, filed on Sep. 17, 1996, having inventors Herbert Kordes and Lars Wehrspann, and DE-OS DE 195 38 485.7, DE 196 33 561.2 and PCT/DE96/01747, and DE-PS DE 195 38 485.7, DE 196 33 561.2 and PCT/DE96/01747, Examples of movable walls and components associated therewith which may be used in conjunction with embodiments of the present invention may be found in the following U.S. Patents: U.S. Pat. No. 5,544,462; U.S. Pat. No. 5,406,761; U.S. Pat. No. 5,328,857; U.S. Pat. No. 5,297,368; U.S. Pat. No. 5,152,332; U.S. Pat. No. 5,042,555; U.S. Pat. No. 4,934,119; U.S. Pat. No. 4,914,878; U.S. Pat. No. 4,835,923; U.S. Pat. No. 4,752,987; U.S. Pat. No. 4,596,094; U.S. Pat. No. 4,458,462; U.S. Pat. No. 4,214,799; U.S. Pat. No. 4,188,758; U.S. Pat. No. 4,120,124; U.S. Pat. No. 4,112,647; U.S. Pat. No. 4,068,432; and U.S. Pat. No. 3,990,205.

Although only a few exemplary embodiments of this invention have been described in detail above, those skilled in the art will readily appreciate that many modifications are possible in the exemplary embodiments without materially departing from the novel teachings and advantages of this invention. Accordingly, all such modifications are intended to be included within the scope of this invention as defined in the following claims. In the claims, means-plus-function clause are intended to cover the structures described herein as performing the recited function and not only structural equivalents but also equivalent structures.

The invention as described hereinabove in the context of the preferred embodiments is not to be taken as limited to all of the provided details thereof, since modifications and variations thereof may be made without departing from the spirit and scope of the invention.

What is claimed is:

1. A movable wall comprising:

a plurality of panels;

a rail to guide said plurality of panels along a given path;

said plurality of panels comprising connecting structure to connect said plurality of panels to said guiding rail;

said plurality of panels being disposed and configured to move along said guiding rail;

each of said plurality of panels having a base;

at least one locking device to lock at least one of said plurality of panels into the floor and to lock said at least one of said plurality of panels into an adjacent one of said plurality of panels;

each said at least one locking device comprising a first portion and a second portion;

said first portion of one of said at least one locking device being disposed in said base of one of said plurality of panels;

said second portion of said one of said at least one locking device being disposed in said base of an adjacent one of said plurality of panels;

said one of said at least one locking device being disposed and configured to automatically lock said one of said plurality of panels into the floor and also to automatically lock said one of said plurality of panels into said adjacent one of said plurality of panels upon contact of said first portion of said one of said at least one locking device with said second portion of said one of said at least one locking device;

said first portion of said at least one locking device and said second portion of said at least one locking device comprising, upon engagement, structure to lock said one of said plurality of panels into the floor and also structure to lock said one of said plurality of panels into said adjacent one of said plurality of panels upon contact of said first portion of said one of said at least one locking device with said second portion of said one of said at least one locking device;

only one of said first portion and said second portion comprising a projecting part extending from its corresponding panel;

the other of said first portion and said second portion comprising a non-projecting receiving portion disposed totally within its panel and configured to receive said projecting part of said one of said first portion and said second portion;

said guiding rail being configured to be disposed on a ceiling of a room;

said base portion of each of said plurality of panels being configured to be disposed adjacent a floor of a room;

each of said plurality of panels comprising a first edge and a second edge;

said first edge and said second edge of each of said plurality of panels being disposed substantially transverse to the floor;

said plurality of panels comprising:

a first end panel;

said second edge of said first end panel being configured to be disposed adjacent a wall;

said first edge of said first end panel comprising a first portion of one of said at least one locking device;

a second end panel;

said second edge of said second end panel being configured to be disposed adjacent a first edge of an adjacent one of said plurality of panels; and said second edge of said second end panel comprising a second portion of one of said at least one locking device;

said plurality of panels further comprising at least one interior panel;

said at least one interior panel being disposed between said first end panel and said second end panel;

said first edge of each of said at least one interior panel being configured to be disposed adjacent a second edge of an adjacent panel of said plurality of panels;

each of said at least one interior panel comprising said first portion of a corresponding first one of said at least one locking device disposed in said first edge of said panel;

each of said at least one interior panel comprising said second portion of a corresponding second one of said at least one locking device disposed in said second edge of said panel;

said first portion of said at least one locking device comprising a locking bolt; and said locking bolt being configured and disposed to automatically lock said one of said plurality of panels into the floor.

2. The movable wall according to claim 1 wherein:

said non-projecting receiving portion comprises a depression;

said second portion of each said at least one locking device comprises said depression in said second edge of said adjacent panel;

said projecting part comprises a projection;

said first portion of each said at least one locking device comprises said projection; and said projection being disposed and configured to be received by said depression to automatically lock said panel and said adjacent panel together upon engagement of said panel and said adjacent panel.

3. The movable wall according to claim 2 wherein:

said first portion of each said at least one locking device comprises a plate;

said plate is fixedly attached to said projection;

said plate comprises a diagonal slot;

said locking bolt comprises a guide pin;

said guide pin is disposed to slide in said diagonal slot; and said diagonal slot is configured to automatically urge said guide pin toward the floor upon engagement of said first portion of said one of said at least one locking device with said second portion of said one of said at least one locking device.

4. The movable wall according to claim 3 wherein:

said first portion of each said at least one locking device comprises a compression spring;

said compression spring is disposed about said locking bolt; and said compression spring is disposed and configured to urge said locking pin away from the floor upon disengagement of said first portion of said of of said at least one locking device from said second portion of said one of said at least one locking device.

5. The movable wall according to claim 1 wherein:

said projecting part comprises a projection;

said second portion of each said at least one locking device comprises said projection; and said non-projecting receiving portion comprises an opening;

said first portion of each said at least one locking device comprises said opening to receive said projection.

6. The movable wall according to claim 5 wherein:

said first portion of each said at least one locking device comprises first and second lever arms;

said first lever arm is rotatably connected to said base of its corresponding panel;

said second lever arm is rotatably connected to said locking bolt;

said first and second lever arms are rotatably connected to one another;

said projection of said second portion of said locking device is disposed and configured to displace said first and second lever arms upon engagement of said first portion and said second portion; and said first and second lever arms are configured to urge said locking bolt into the floor upon engagement of said first portion and said second portion of said locking device.

7. The movable wall according to claim 6 wherein:

said first portion of each said at least one locking device comprises a spring; and said spring is configured and disposed to urge said locking bolt away from the floor upon disengagement of said first portion and said second portion of said locking device.

8. The movable wall according to claim 5 wherein:

said projection of said second portion of each said at least one locking device comprises a diagonal slot;

said locking bolt of said first portion of each said at least one locking device comprises a pin;

said pin is disposed to engage said diagonal slot in said projection; and said diagonal slot in said projection is disposed and configured to urge said locking bolt into the floor upon engagement of said first portion of said locking device and said second portion of said locking device.

9. The movable wall according to claim 8 wherein:

said locking bolt of said first portion of each said at least one locking device comprises a retaining groove disposed about said locking bolt;

said first portion of each said at least one locking device comprises a retaining pin;

said retaining pin is disposed to engage said retaining groove upon said first portion of said locking device being disengaged from said second portion of said locking device; and said retaining pin is disposed and configured to hold said locking bolt in a disengaged position upon said first portion of said locking device being disengaged from said second portion of said locking device.

10. A movable wall comprising:

a plurality of panels;

a guiding structure;

said plurality of panels comprising connecting structure to connect said plurality of panels to said guiding structure;

said plurality of panels being disposed and configured to move along said guiding structure;

each of said plurality of panels having a base;

at least one locking device;

each said at least one locking device comprising a first portion and a second portion;

said first portion of one of said at least one locking device being disposed in said base of one of said plurality of panels;

said second portion of said one of said at least one locking device being disposed in said base of an adjacent one of said plurality of panels;

said one of said at least one locking device being disposed and configured to automatically lock said one of said plurality of panels into the floor and also to automatically lock said one of said plurality of panels into said adjacent one of said plurality of panels upon contact of said first portion of said one of said at least one locking device with said second portion of said one of said at least one locking device;

only one of said first portion and said second portion comprising a projecting part extending from its corresponding panel;

the other of said first portion and said second portion comprising a non-projecting receiving portion disposed totally within its panel and configured to receive said projecting part of said one of said first portion and said second portion;

said guiding structure being configured to be disposed on a ceiling of a room;

said base portion of each of said plurality of panels being configured to be disposed adjacent a floor of a room;

each of said plurality of panels comprising a first edge and a second edge;

said first edge and said second edge of each of said plurality of panels being disposed substantially transverse to the floor;

said plurality of panels comprising:

a first end panel;

said second edge of said first end panel being configured to be disposed adjacent a wall;

said first edge of said first end panel comprising said first portion of one of said at least one locking device;

a second end panel;

said second edge of said second end panel being configured to be disposed adjacent a first edge of an adjacent one of said plurality of panels;

said second edge of said second end panel comprising said second portion of one of said at least one locking device;

at least one interior panel; and said at least one interior panel is disposed between said first end panel and said second end panel;

said first edge of each of said at least one interior panel being configured to be disposed adjacent a second edge of an adjacent panel of said plurality of panels;

each of said at least one interior panel comprising said first portion of a corresponding first one of said at least one locking device disposed in said first edge of said panel;

each of said at least one interior panel comprising said second portion of a corresponding second one of said at least one locking device disposed in said second edge of said panel;

said first portion of said at least one locking device comprising a locking bolt; and said locking bolt being configured and disposed to automatically lock said one of said plurality of panels into the floor.

11. The movable wall according to claim 10 wherein:

said non-projecting receiving portion comprises a depression;

said second portion of each said at least one locking device comprises said depression in said second edge of said adjacent panel;

said projecting part comprises a projection;

said first portion of each said at least one locking device comprises said projection;

said projection being disposed and configured to be received by said depression to automatically lock said panel and said adjacent panel together upon engagement of said panel and said adjacent panel;

said first portion of each said at least one locking device comprises a plate;

said plate is fixedly attached to said projection;

said plate comprises a diagonal slot;

said locking bolt comprises a guide pin;

said guide pin is disposed to slide in said diagonal slot;

said diagonal slot is configured to automatically urge said guide pin toward the floor upon engagement of said first portion of said one of said at least one locking device with said second portion of said one of said at least one locking device;

said first portion of each said at least one locking device comprises a compression spring;

said compression spring is disposed about said locking bolt; and said compression spring is disposed and configured to urge said locking pin away from the floor upon disengagement of said first portion of said one of said at least one locking device from said second portion of said one of said at least one locking device.

12. The movable wall according to claim 10 wherein:

said projecting part comprises a projection;

said second portion of each said at least one locking device comprises said projection;

said non-projecting receiving portion comprises an opening;

said first portion of each said at least one locking device comprises said opening to receive said projection;

said first portion of each said at least one locking device comprises first and second lever arms;

said first lever arm is rotatably connected to said base of its corresponding panel;

said second lever arm is rotatably connected to said locking bolt;

said first and second lever arms are rotatably connected to one another;

said projection of said second portion is disposed and configured to displace said first and second lever arms upon engagement of said first portion and said second portion;

said first and second lever arms are configured to urge said locking bolt into the floor upon engagement of said first portion and said second portion;

said first portion of each said at least one locking device comprises a spring; and said spring is configured and disposed to urge said locking bolt away from the floor upon disengagement of said first portion and said second portion.

13. The movable wall according to claim 10 wherein:

said projecting part comprises a projection;

said second portion of each said at least one locking device comprises said projection;

said non-projecting receiving portion comprises an opening;

said first portion of each said at least one locking device comprises said opening to receive said projection;

said projection of said second portion of each said at least one locking device comprises a diagonal slot;

said locking bolt of said first portion of each said at least one locking device comprises a pin;

said pin is disposed to engage said diagonal slot in said projection;

said diagonal slot in said projection being disposed and configured to urge said locking bolt into the floor upon engagement of said first portion of said locking device and said second portion of said locking device;

said locking bolt of said first portion of each said at least one locking device comprises a retaining groove disposed about said locking bolt;

said first portion of each said at least one locking device comprises a retaining pin;

said retaining pin is disposed to engage said retaining groove upon said first portion of said locking device being disengaged from said second portion of said locking device; and said retaining pin is disposed and configured to hold said locking bolt in a disengaged position upon said first portion of said locking device being disengaged from said second portion of said locking device.

* * * * *